US005344371A

United States Patent [19]

Wang

[11] Patent Number: 5,344,371

[45] Date of Patent: Sep. 6, 1994

[54] EXERCISER FOR SIMULATING MOUNTAIN CLIMBING AND RUNNING MOVEMENTS

[75] Inventor: Leao Wang, Taichung Hsien, Taiwan

[73] Assignee: Greenmaster Industrial Corp., Taiwan

[21] Appl. No.: 134,734

[22] Filed: Oct. 12, 1993

[51] Int. Cl.[5] ..... A63B 23/04

[52] U.S. Cl. ..... 482/53; 482/51; 482/70

[58] Field of Search ..... 482/52, 53, 70, 114, 482/115, 116, 117, 118, 120, 51

[56] References Cited

U.S. PATENT DOCUMENTS

| | | | |
|---|---|---|---|
| 1,572,281 | 2/1926 | Fry | 482/118 |
| 4,659,077 | 4/1987 | Stropkay | 482/51 |
| 4,709,918 | 12/1987 | Grinblat | 482/118 |
| 5,000,441 | 3/1991 | Wang | 482/51 |
| 5,246,412 | 9/1993 | Chen | 482/51 |

FOREIGN PATENT DOCUMENTS

| | | | |
|---|---|---|---|
| 4222484 | 11/1992 | U.S.S.R. | 482/115 |

*Primary Examiner*—Stephen R. Crow
*Attorney, Agent, or Firm*—Beveridge, DeGrandi, Weilacher & Young

[57] ABSTRACT

An exerciser is provided for simulating the movement of mountain climbing and running. The exerciser is equipped with a pulling unit in the front top portion of a main supporting strut. The pulling unit and a set of two pedals are independent from each other so that the user can pull the pulling unit to simulate the movements of mountaineering and running. A rotating wheel with two slide slots is rotatably installed inside an indentation in the end of a bending extension of the main strut. Two transmission ropes are wrapped around the two slide slots in opposite directions. Each of the two transmission ropes passes through a guide wheel and a positioning wheel respectively, and two handles of the transmission ropes are connected to both sides of the body of the exerciser so that the pulling angle of the two transmission ropes can be enlarged. In this manner, the user can simulate the movement of mountain climbing and running by treading on the pedals and pulling the transmission ropes simultaneously.

6 Claims, 4 Drawing Sheets

EXERCISER FOR SIMULATING MOUNTAIN CLIMBING AND RUNNING MOVEMENTS

BACKGROUND OF THE INVENTION

The present invention provides an exerciser which can be used to simulate the movement of mountaineering. A pulling installation is provided in the front top of the main supporting strut, whose operation is independent of the two-pedal set so that the user can enjoy the fun of mountaineering by pulling the transmission ropes and treading on pedals simultaneously or respectively.

The traditional exerciser is designed only for training the user's lower extremity or exhausting the user's calories, without any other functions. In view of such drawback, the inventor of the present invention developed a brand new exerciser with more functions to eliminate the aforesaid disadvantage.

SUMMARY OF THE INVENTION

It is the main object of the present invention to provide an exerciser equipped a pulling installation for the user to swing both arms correspondingly when he is treading on pedals up-and-down. Moreover, the present invention can be adapted by the user to simulate the movement of mountaineering and running.

It is therefore another object of the present invention to provide a more humanized exerciser. The pulling installation and pedals can be operated independently, without interfering with each other. Therefore, even the disabled or a patient can exercise in their own way.

DETAILED DESCRIPTION OF THE PREFERRED EMBODIMENT

Figure 1A:
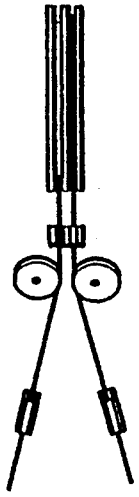
FIG. 1A is the front plan view from top to bottom of the pulling installation of the present invention.
Figure 1:
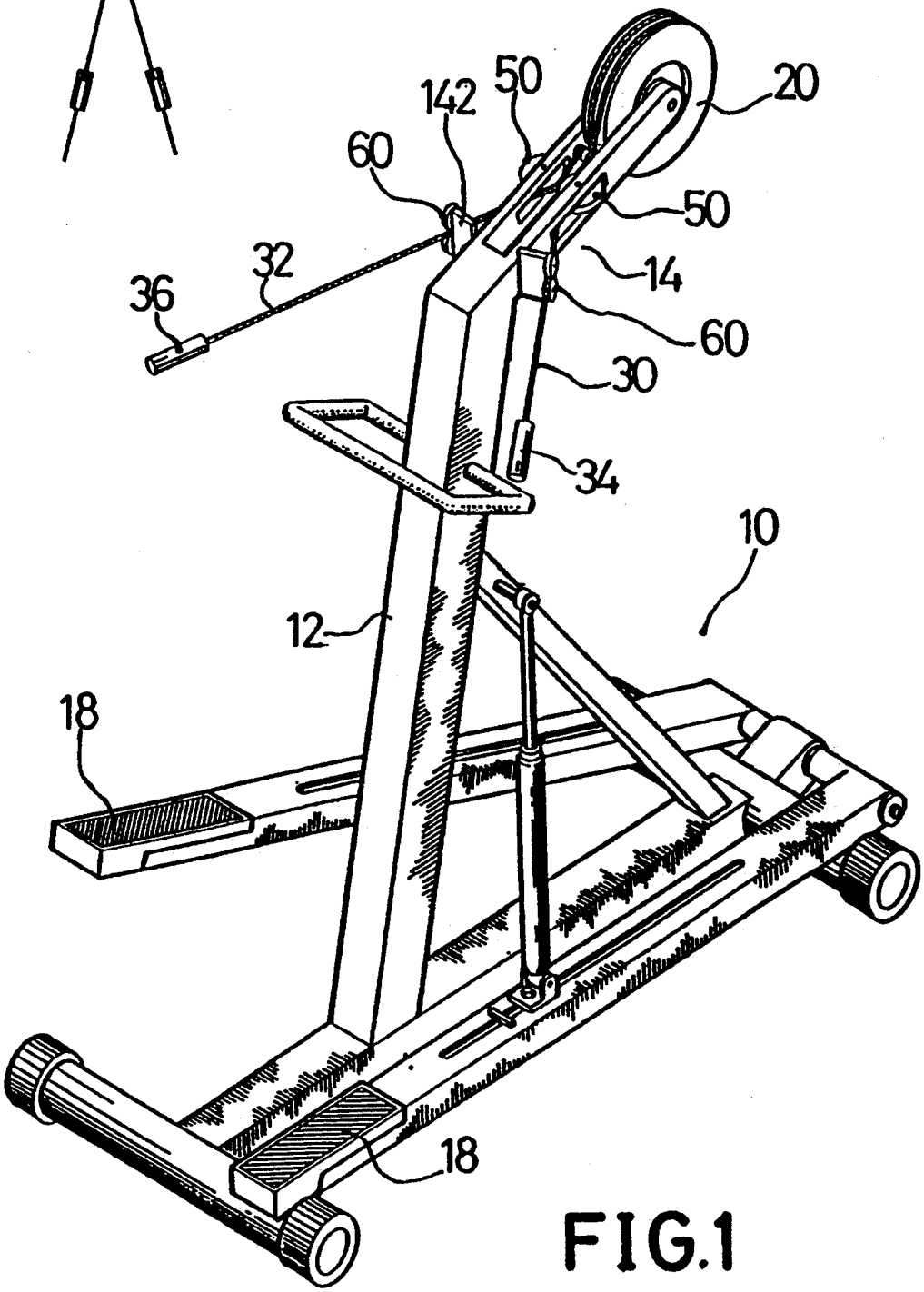
FIG. 1 is an assembly view of the present invention.
Figure 2:
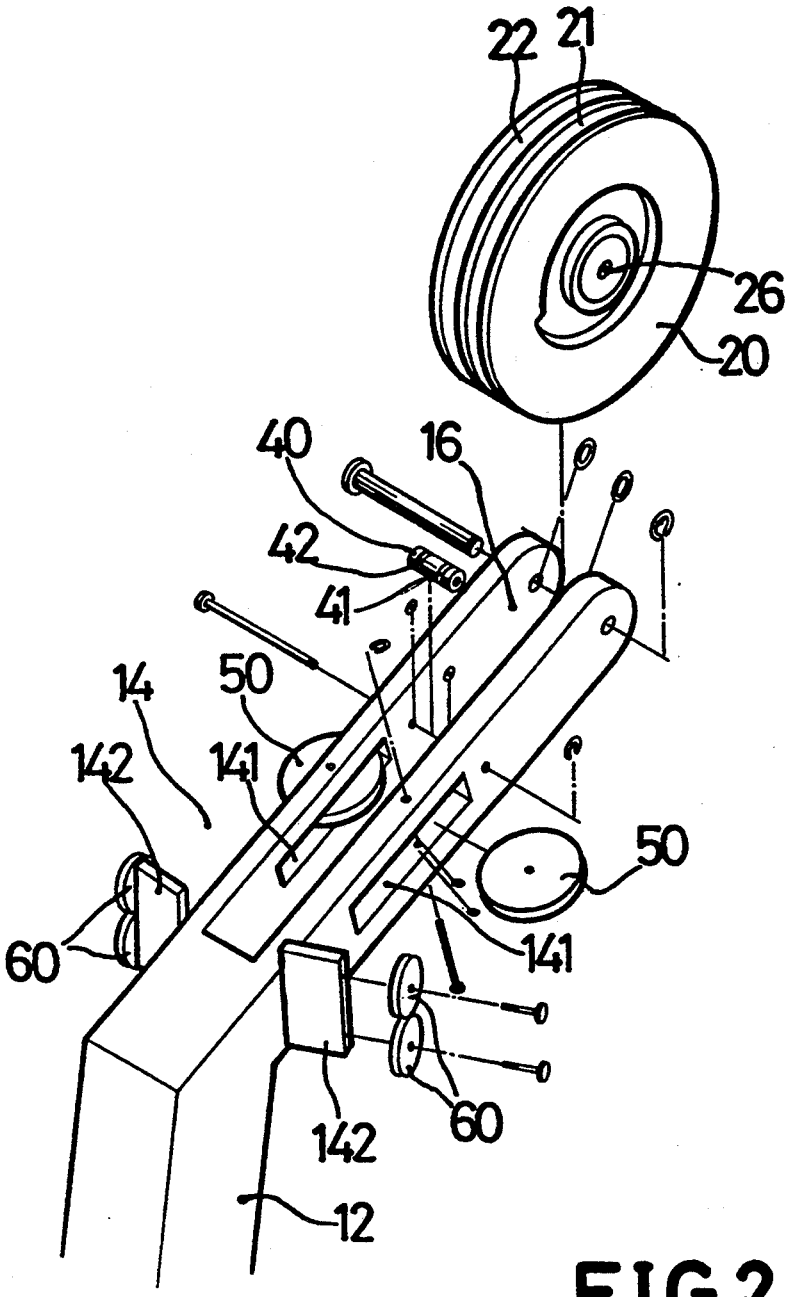
FIG. 2 is an exploded view of part of the structure of the present invention.

Referring to FIG. 1 and FIG. 2, an exerciser in accordance with the present invention is generally comprised of a body 10, a main supporting strut 12, a bending extension 14, and a slim indentation 16 in the end of the bending extension 14. A rotating wheel 20 with two slide slots 21 and 22 is installed vertically and rotatably inside the indentation 16, two transmission ropes 30, 32 are wrapped around the slide slots 21 and 22 of the rotating wheel 20 in opposite directions. Each of the two transmission ropes 30 and 32 passes through guide wheel 40, positioning wheel 50 and pulley block 60 and connects with handle 34 and 36 respectively on both sides of the body 10 so that the pulling angle of the transmission ropes 30 and 32 can be increased. The user can tread on pedals 18 and pull the two transmission ropes 30 and 32 at the same time to simulate the movement of mountain climbing.

The guide wheel 40 is installed rotatably in the indentation 16 of the bending extension 14, and its position is very close to the outer rim of the rotating wheel 20. The object of the installation of guide wheel 40 is to change the direction of the two transmission ropes 30 and 32 and guide them to the appropriate position. After the two transmission ropes 30 and 32 have been wrapped around the rotating wheel 20, the guide slots 41 and 42 of guide wheel 40 limit the pulling tangent of the transmission ropes 30 and 32 to the upper and lower end of the rotating wheel 20.

Due to the installation of the indentation 16, the shape of the bending extension 14 is just like a fork, wherein two openings 141, where the two positioning wheels 50 are installed rotatably, are provided, one on each side of the fork.

Two vertical plates 142 connect to both sides of the bending extension 14 respectively and two pulley blocks 60 are installed rotatably in the edge of each vertical plate 142 respectively. The axle direction of the pulley block is slightly outward.

Figure 3:
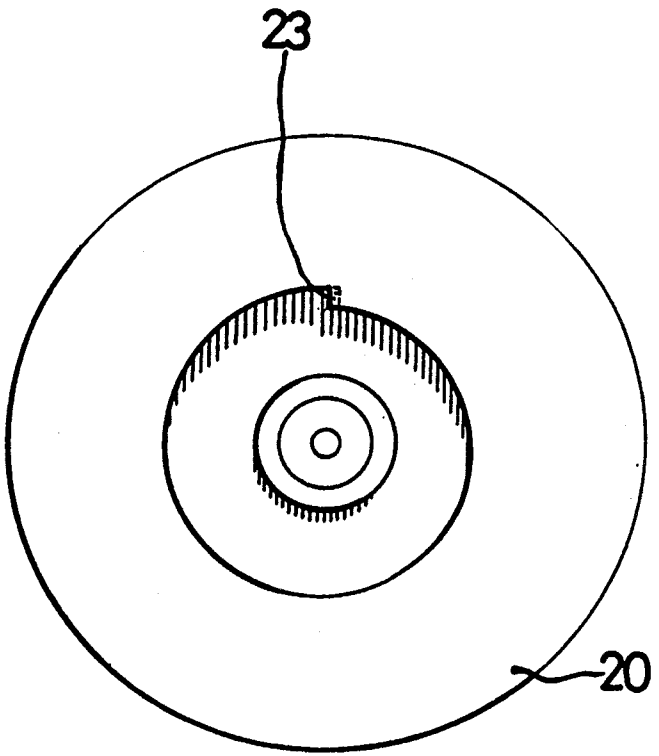
FIG. 3 is an illustration of the rotating wheel of the present invention.
Figure 4:
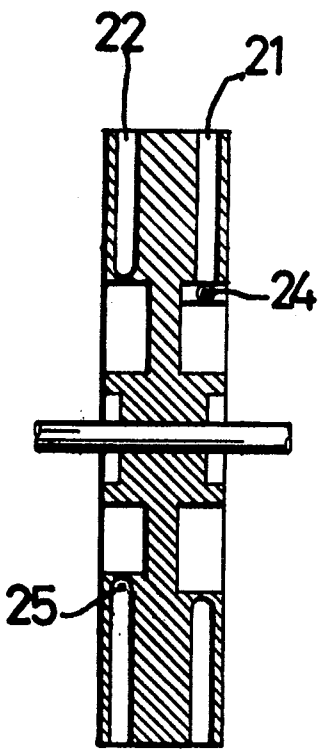
FIG. 4 is a sectional view along the line A—A in FIG. 3.

Referring to FIG. 3 and FIG. 4, the bottom of the slide slots 21 and 22 of the rotating wheel 20 has snail-like lines in opposite direction, passing holes 24 and 25 are installed in the sectional surface 23 of the lines respectively, and the two transmission ropes 30 and 32 pass through said passing holes 24 and 25 respectively and wrap around the slide slots 21 and 22 in opposite directions respectively. Each of the two transmission ropes 30 and 32 has its one end positioned on the outside of the passing holes 24 and 25.

After the two transmission ropes 30 and 32 have been wrap around the rotating wheel 20, the transmission ropes 30 and 32 pass through the center axle hole 26 of the rotating wheel and twine around the two guide slots 41 and 42 of guide wheel 40, along their tangent respectively, one on the top, the other on the bottom. (See the illustration in FIG. 1A) Afterward, each of the two transmission ropes 30 and 32 passes through its own corresponding positioning wheel 50, then passes through the opening 141 of the bending extension 14 of the body 10. Finally, each of them passes through the neighboring slots of the corresponding pulley block 60 so that the two transmission ropes would not slip away and the pulling angle could be enlarged. Handles 34 and 36 are connected with the end of each of the transmission ropes 30 and 32.

The user can hold and pull the handles 34 and 36 and tread on the pedals 18, since the transmission ropes are wrapped around the rotating wheel 20 in opposite directions, when one of the user's arm pulls back one of the ropes, the other rope would be raised up.

Figure 5:
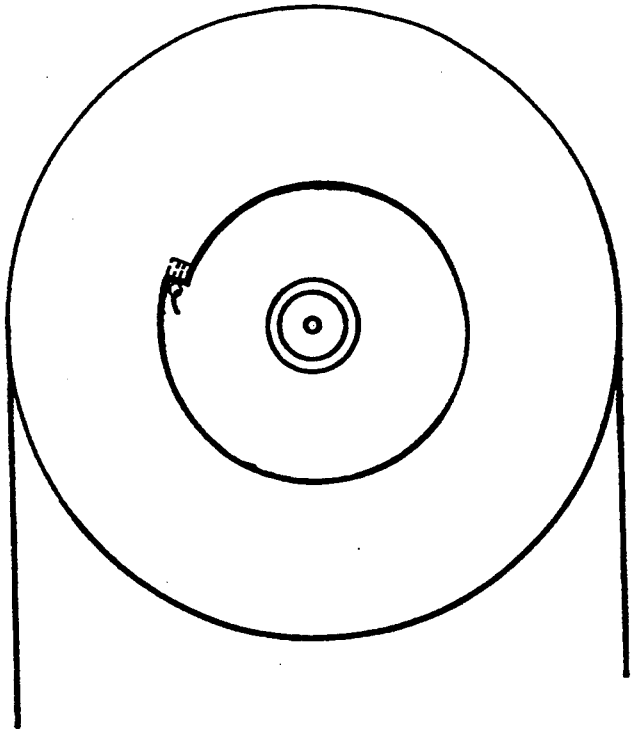
FIG. 5 is the illustration of a rotating wheel arrangement for use in the present invention.

Moreover, the slide slots 21 and 22 of the rotating wheel 20 can be connected to the bending extension 14 rotatably and horizontally so that the transmission ropes 30 and 32 on both sides of the rotating wheel 20 can be pulled directly by the user. (See FIG. 5 and FIG. 6)

Figure 6:
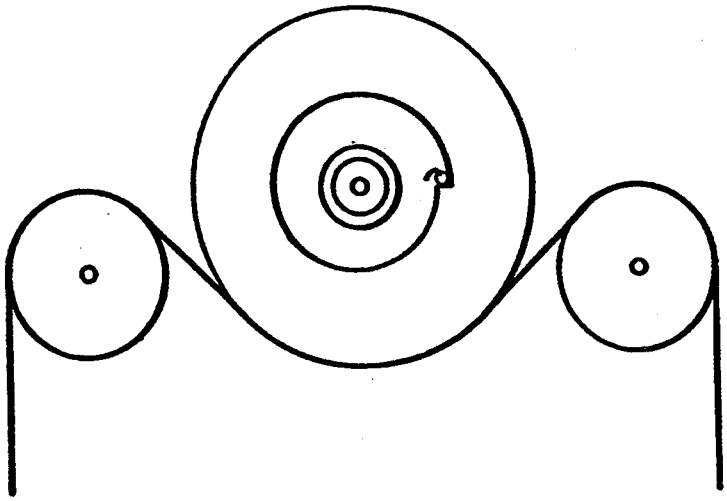
FIG. 6 is the illustration of another rotating wheel arrangement for use in the present invention.

Referring to FIG. 6, two guide wheels are installed, one on each side of the rotating wheel 20 for increasing the pulling angle. Therefore, the diameter of the rotating wheel 20 can be reduced.

The unique design concept of the present invention has completely eliminated the drawbacks of the traditional exerciser.

What is claimed is:

1. An exercise device for simulating mountain climbing and running movement, comprising: a body including a main supporting strut, a bending extension extending from the main supporting strut, and an indentation defined in one end of said bending extension, wherein a rotating wheel with two slide slots is rotatably installed inside said indentation, two transmission ropes, each including a handle at an end thereof, are wrapped around said slide slots of said rotating wheel in opposite directions, the transmission ropes further passing through a guide wheel, positioning wheels, and pulley blocks on said body, said body further including two pedals, whereby a user can tread on the pedals and pull said two transmission ropes at the same time to simulate the movement of mountain climbing.

2. An exercise device as in claim 1, wherein said guide wheel is rotatably installed inside said indentation of said bending extension, wherein said guide wheel is adjacent an outer rim of said rotating wheel to thereby limit a pulling tangent of said transmission ropes.

3. An exercise device as in claim 1, wherein said indentation makes said bending extension fork shaped, wherein two openings are defined in said bending extension for rotatably installing two positioning wheels.

4. An exercise device as in claim 1, wherein two plates are connected to said bending extension, one plate on each side of said bending extension, wherein said plates are provided for installing two pulley blocks in a rotatable manner at an edge of each plate, wherein an axle direction of said two pulley blocks is outward with respect to said bending extension.

5. An exercise device as in claim 1, wherein a bottom of said slide slots of said rotating wheel has snail-like lines in opposite directions, wherein two passing holes are defined in a sectional surface of said lines respectively, wherein said two transmission ropes pass through said passing holes, respectively, and wrap around the slide slots in opposite directions, respectively, wherein each of the two transmission ropes has one end extending outside of said passing holes.

6. An exercise device as in claim 1, wherein said rotating wheel is rotatably connected to the bending extension so that the transmission ropes on both sides of said rotating wheel can be pulled directly by the user, and wherein two guide wheels are installed adjacent said rotating wheel, one guide wheel on each side of said rotating wheel, wherein said guide wheels are provided for increasing a pulling angle of said transmission ropes, thereby enabling the diameter of said rotating wheel to be reduced.

* * * * *